US007739811B2

(12) United States Patent
Theurer et al.

(10) Patent No.: US 7,739,811 B2
(45) Date of Patent: Jun. 22, 2010

(54) METHOD AND INSTALLATION FOR REHABILITATING A BALLAST BED

(75) Inventors: Josef Theurer, Vienna (AT); Manfred Brunninger, Altenberg (AT)

(73) Assignee: Franz Plasser Bahnbaumaschinen-Industriegesellschaft m.b.H., Vienna (AT)

( * ) Notice: Subject to any disclaimer, the term of this patent is extended or adjusted under 35 U.S.C. 154(b) by 3 days.

(21) Appl. No.: 12/152,015

(22) Filed: May 12, 2008

(65) Prior Publication Data

US 2008/0251265 A1 Oct. 16, 2008

Related U.S. Application Data

(63) Continuation of application No. PCT/EP2006/066399, filed on Sep. 15, 2006.

(30) Foreign Application Priority Data

Nov. 14, 2005 (AT) ..... A 1851/2005

(51) Int. Cl.
*E01B 27/00* (2006.01)

(52) U.S. Cl. ..... 37/104; 171/16; 104/7.3

(58) Field of Classification Search ..... 37/104, 37/105, 106, 107; 104/7.1, 7.2, 7.3; 171/16
See application file for complete search history.

(56) References Cited

U.S. PATENT DOCUMENTS

| | | | | |
|---|---|---|---|---|
| 3,316,666 | A * | 5/1967 | Speno | 37/107 |
| 4,063,375 | A * | 12/1977 | Satterwhite | 37/190 |
| 5,479,725 | A | 1/1996 | Theurer et al. | |
| RE35,788 | E * | 5/1998 | Theurer et al. | 37/104 |
| 6,619,405 | B2 * | 9/2003 | Theurer et al. | 171/16 |
| 6,637,133 | B2 | 10/2003 | Theurer et al. | |
| 6,672,398 | B2 * | 1/2004 | Theurer et al. | 171/16 |
| 2002/0157839 | A1 | 10/2002 | Theurer et al. | |

FOREIGN PATENT DOCUMENTS

| | | |
|---|---|---|
| EP | 0 790 352 | 8/1997 |
| EP | 0 681 062 | 3/2000 |

OTHER PUBLICATIONS

International Search Report.

* cited by examiner

*Primary Examiner*—Gary S Hartmann
(74) *Attorney, Agent, or Firm*—Collard & Roe, P.C.

(57) ABSTRACT

In a method of rehabilitating a ballast bed of a track by excavating contaminated ballast and conveying the excavated contaminated ballast by a first conveyor band unit to a screening unit for cleaning the excavated contaminated ballast, the ballast bed is rehabilitated selectively, in dependence on the degree of contamination of the ballast, in a first or second operating stage. The first operating stage comprises the steps of excavating an upper layer of the ballast by a first excavating device which precedes a second excavating device, in an operating direction, and conducting the excavated upper ballast layer to the first conveyor band unit while, at the same time, the remainder of the ballast is excavated by the second excavating device and is conducted to a second conveyor band unit for disposal. The second operating stage comprises the steps of excavating the ballast solely by the second excavating device and deflecting the excavated ballast to the first conveyor band unit for cleaning while the first excavating device is inoperative.

1 Claim, 2 Drawing Sheets

METHOD AND INSTALLATION FOR REHABILITATING A BALLAST BED

CROSS-REFERENCE TO RELATED APPLICATIONS

Applicants claim priority under 35 U.S.C. §119 of Austrian Application No. A 1851/2005, filed on Nov. 14, 2005. Applicants also claim priority under 35 U.S.C. §120 of International Application No. PCT/EP2006/066399 filed on Sep. 15, 2006. This application is a by-pass continuation application of said International Application No. PCT/EP2006/066399 filed on Sep. 15, 2006. The International application under PCT Article 21(2) was not published in English. The disclosures of the aforementioned International application and Austrian application are incorporated by reference herein.

BACKGROUND OF THE INVENTION

1. Field of the Invention

The present invention relates to a method and installation for rehabilitating a ballast bed of a track.

2. Description of the Prior Art

EP 0 681 062 B1 and EP 0 790 352 A2 (corresponding to U.S. Pat. No. 5,479,725 reissued as Re. 35,788) discloses a method and installation for rehabilitating a ballast bed of a track, in which a first ballast excavating device preceding a second ballast excavating device excavates an upper ballast layer and conveys the excavated upper ballast layer to a screening unit for cleaning so that the cleaned ballast may be returned to the ballast bed. The remainder of the heavily contaminated ballast underneath the upper ballast layer is excavated by the second ballast excavating device and is temporarily stored in a storage hopper for disposal. The exposed subgrade is then improved by forming a protective layer over it.

U.S. Pat. No. 6,637,133 discloses a ballast cleaning machine designed to enhance efficiency with the use of two ballast cleaning devices operating in unison, the ballast excavated by both excavating devices being conveyed to a screening unit for cleaning. Such an arrangement requires a highly efficient screening unit.

SUMMARY OF THE INVENTION

It is the primary object of this invention to provide a ballast bed rehabilitation which is well adapted to different ballast bed conditions, such as relatively lightly contaminated and heavily contaminated ballast beds.

The above and other objects are accomplished according to one aspect of the invention with a method of rehabilitating a ballast bed of a track by excavating contaminated ballast and conveying the excavated contaminated ballast by a first conveyor band unit to a screening unit for cleaning the excavated contaminated ballast, in which the ballast bed is rehabilitated selectively, in dependence on the degree of contamination of the ballast, in a first or second operating mode. The first operating mode comprises the steps of excavating an upper layer of the ballast by a first excavating device which precedes a second excavating device, in an operating direction, and conducting the excavated upper ballast layer to the first conveyor band unit while, at the same time, the remainder of the ballast is excavated by the second excavating device and is conducted to a second conveyor band unit for disposal. The second operating mode comprises the steps of excavating the ballast solely by the second excavating device and deflecting the excavated ballast to the first conveyor band unit for cleaning while the first excavating device is inoperative.

According to another aspect, the present invention provides an installation for rehabilitating a ballast bed of a track by excavating contaminated ballast, which comprises a train of cars moving in an operating direction, a first ballast excavating device preceding a second ballast excavating device, in the operating direction, the first ballast excavating device being arranged to excavate an upper layer of the ballast, a first conveyor band unit arranged to receive and convey the excavated upper ballast layer from the first ballast excavating device to a screening unit arranged to receive the conveyed excavated upper ballast layer, the second ballast excavating device being arranged to excavate the ballast underneath the upper ballast layer, a second conveyor band unit having an end receiving the ballast excavated by the second ballast excavating device and conveying the excavated said ballast to an end of the installation, and a deflecting device for selectively deflecting ballast from the second to the first conveyor band unit.

The selective use of one or the other operating mode makes it possible to adjust advantageously to prevailing ballast conditions and thus to optimize the rehabilitation work. Depending on the extent of contamination of the ballast bed, it is possible to clean only the upper layer of the ballast while the remainder of the ballast underneath the upper ballast layer is removed by the second ballast excavating unit and is conveyed by the second conveyor band unit for disposal without being cleaned and used again. On the other hand, it is also possible to excavate the entire ballast bed with the second, larger ballast excavating device and to convey the excavated ballast to the screening unit for cleaning, whereupon the cleaned ballast is returned to the subgrade.

BRIEF DESCRIPTION OF THE DRAWING

The above and other objects, features and advantages of this invention will become more apparent from the following detailed description of a now preferred embodiment, taken in conjunction with the accompanying drawing wherein.

DETAILED DESCRIPTION OF THE PREFERRED EMBODIMENT

Figure 1:
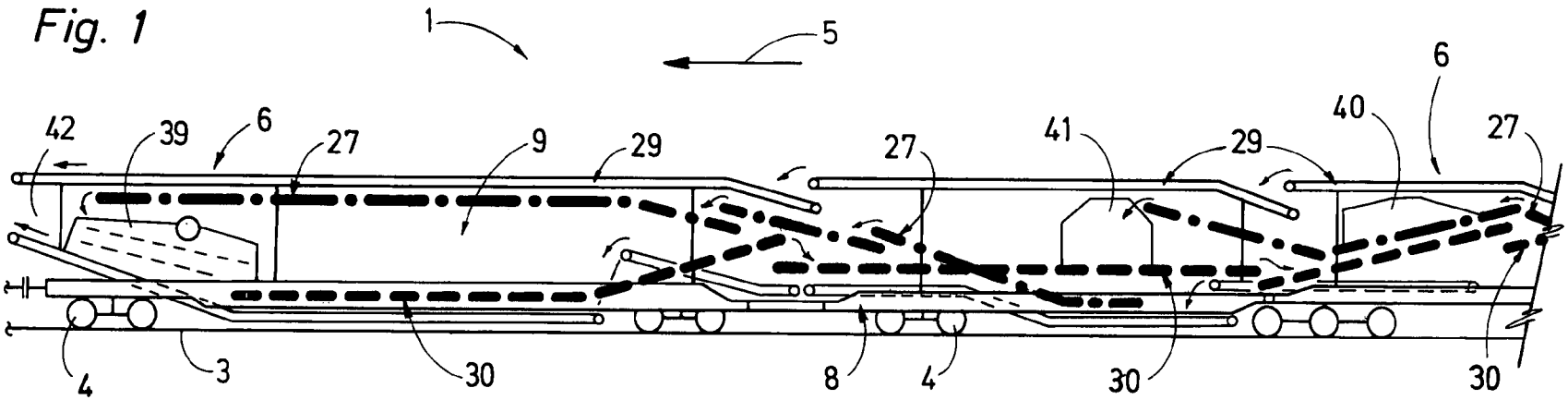
FIGS. 1 and 2 are side elevational views showing, respectively, the front and rear parts of a train of cars constituting the installation according to the invention, in the first operating mode.

The drawing illustrates installation 1 for rehabilitating ballast bed 2 of track 4 by excavating contaminated ballast. The installation comprises a train of cars 6 supported on undercarriages 4 for moving on the track in an operating direction indicated by arrow 5. The cars include ballast excavating car 7 preceded, in the operating direction, by ballast processing car 8 and screening car 9, as well as other cars not further described.

Excavating car 7 is comprised of a machine frame 13 consisting of two carrier frames 11, 12, which are hinged together by link 10. The two carrier frames may be spread apart by spreading drive 14 arranged above link 10. This enables an undercarriage 4 located in the area of link 10 to be raised while remaining in contact with the track, the track being raised automatically with the undercarriage while being held by track grippers 15.

A first ballast excavating device 16 precedes a second ballast excavating device 20, in the operating direction. The first ballast excavating device is generally conventional and is arranged on carrier frame 11 to excavate an upper layer of contaminated ballast 25. It includes revolving endless excavating chain 19 and may be vertically and laterally adjusted by drives 17, and revolved by drive 18. A first conveyor band unit 27, shown in heavy dot-dash lines, has an inlet end 26 arranged to receive the excavated upper ballast layer from the first ballast excavating device and to convey it to a screening unit 39 arranged on screening car 9 to receive the conveyed excavated upper ballast layer. First conveyor band unit 27 extends along the train, passing over ballast processing car 8 to screening car 9.

The second ballast excavating device 20 is arranged on carrier frame 12 to excavate the ballast underneath the upper ballast layer. The second conveyor band unit is also generally conventional and is arranged on carrier frame 12 to excavate contaminated ballast 25 underneath the upper ballast layer. It includes revolving endless excavating chain 23 and may be vertically and laterally adjusted by drives 21, and revolved by drive 22. A second conveyor band unit 29, shown in broken lines, has an inlet end 28 arranged to receive the excavated ballast underneath the upper ballast layer from the second ballast excavating device and to convey it to a forward end of the train. Second conveyor band unit 29 extends along the train, passing over ballast processing car 8 to screening car 9 generally parallel to, and above the first conveyor band unit.

A third conveyor band unit 30, shown in heavy broken lines, is provided to return the cleaned ballast coming from screening unit 39 to track 3 at a point behind the second ballast excavating device.

According to the invention, deflecting device 33 is arranged at forward end 32 of excavating car 7 for selectively deflecting ballast 25 from the second to the first conveyor band unit. The illustrated deflecting device comprises a pivoting drive 24 enabling rear end 35 of section 36 of second conveyor band unit 29 to be moved upwardly (see FIG. 4). This makes section 37 of first conveyor band unit 27 accessible to receive the ballast conveyed by second conveyor band unit 29 so that the ballast excavated by second excavating device 20 is conveyed by the first conveyor band unit to the screening device 39 for cleaning.

The selective method of operation of installation 1 will now be explained in detail:

In the illustrated method of rehabilitating a ballast bed of a track by excavating contaminated ballast and conveying the excavated contaminated ballast by a first conveyor band unit to a screening unit for cleaning the excavated contaminated ballast, the ballast bed is rehabilitated selectively, in dependence on the degree of contamination of the ballast, in a first or second operating mode.

Figure 2:
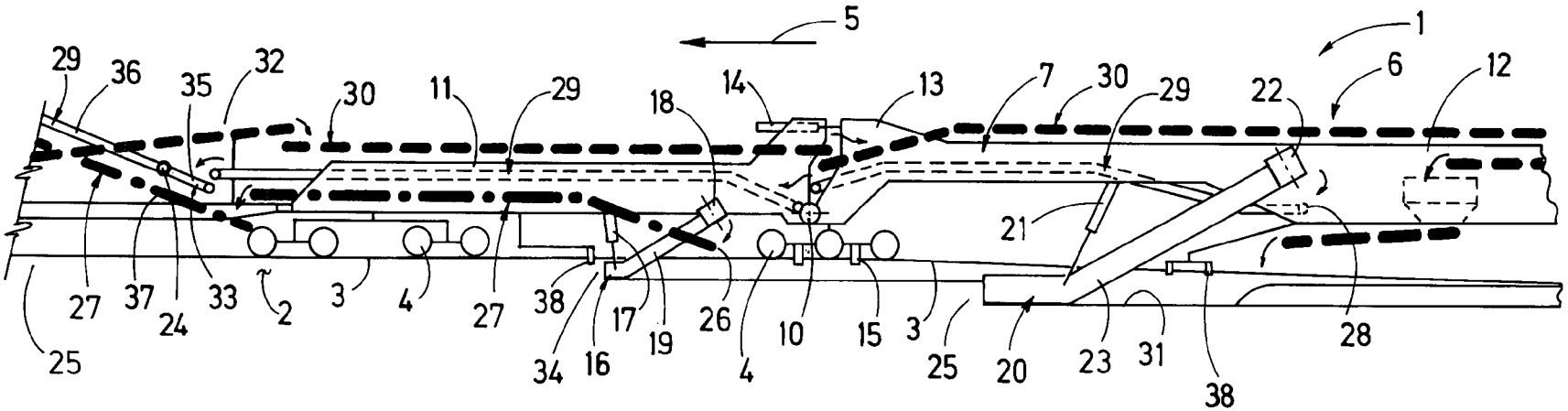

The first operating mode is illustrated in FIGS. 1 and 2. It comprises the steps of excavating an upper layer 34 of the ballast by first excavating device 16 which precedes a second excavating device 20, in operating direction 5. During excavation, track 3 is gripped by grippers 15 and further grippers 38 and raised. The excavated contaminated upper ballast layer is conducted to inlet end 26 of first conveyor band unit 27. As shown by small arrows, contaminated ballast 25 is conveyed forwardly in the operating direction by the first conveyor band unit to screening unit 39. As the contaminated ballast passes over ballast processing car 8, it may be pretreated, if desired, by a separator 40 and/or a crusher 41, which increases the cleaning efficiency. The cleaned ballast coming from screening device 39 is returned by third conveyor band unit 30 and is thrown onto subgrade 31 behind second excavating device 20.

At the same time, the remainder of the contaminated ballast 25 is excavated by second excavating device 20 and is conducted to second conveyor band unit 29, which conveys the excavated ballast to forward end 42 of installation 1 for disposal. This ballast, together with any detritus coming from separator 40 and/or crusher 41, is loaded on freight cars (not shown).

Figure 3:
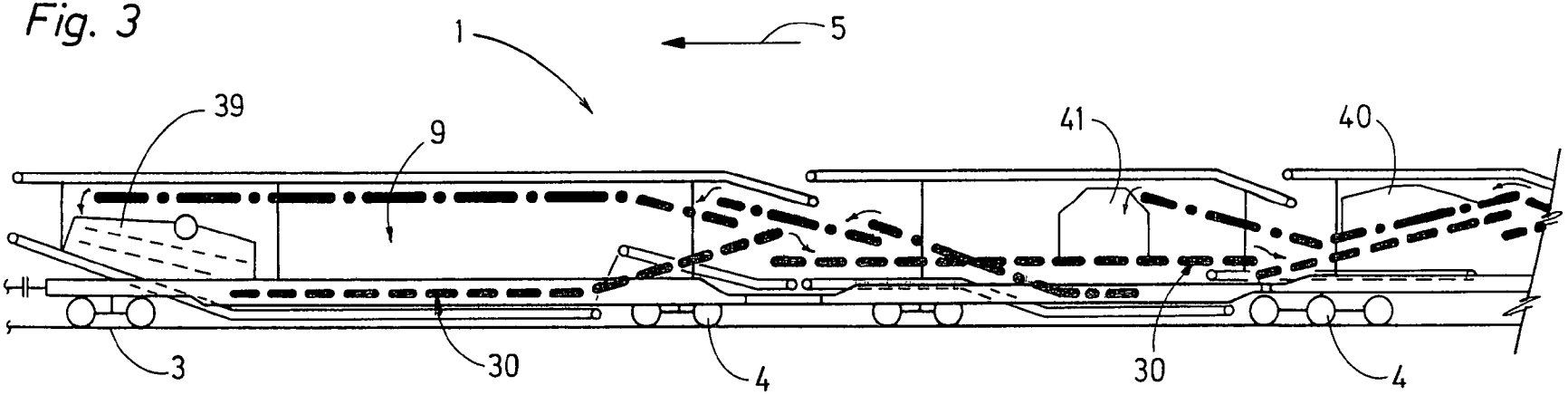
FIGS. 3 and 4 are side elevational views showing, respectively, the front and rear parts of the train of cars constituting the installation according to the invention, in the second operating mode.
Figure 4:
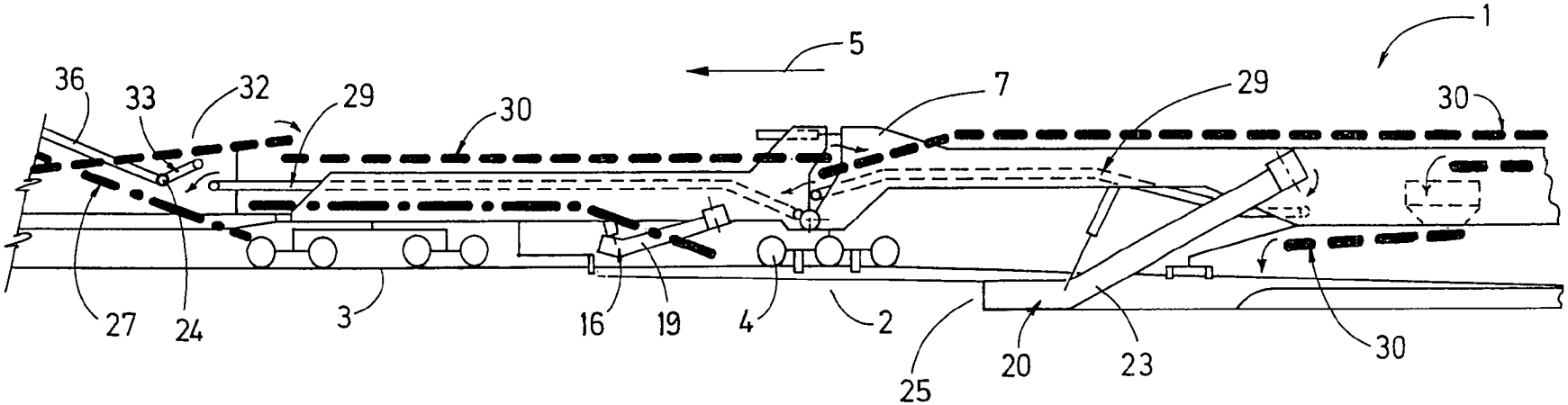

The alternative second operating mode (shown in FIGS. 3 and 4) comprises the steps of excavating the ballast solely by second excavating device 20 and deflecting the excavated ballast to first conveyor band unit 27 for cleaning while the first excavating device 16 is inoperative. As shown in FIG. 4, excavating chain 19 is raised by drive 17 into its inoperative position. In this operating stage, installation 1 works at high efficiency to excavate the entire ballast bed 2. The excavated ballast is conveyed by second conveyor band unit 29 and is deflected to first conveyor band unit 27 by raising section 33 at forward end 32 of excavating car 7 so that the excavated ballast may be conveyed to screening unit 39 for cleaning. The cleaned ballast is returned to the track by third conveyor band unit 30.

The cleaning efficiency is enhanced if the excavated contaminated ballast is pre-cleaned by separator 40 and crusher 41. This enables the large amount of contaminated ballast excavated by the large, efficient excavating chain 23 to be cleaned in a single screening unit.

Other embodiments of deflecting device 33 than the one illustrated may be used. For instance, end 33 of conveyor band section 36 could be laterally pivoted, instead of being raised, or it may be displaced in a longitudinal direction to make underlying conveyor band section 37 accessible.

What is claimed is:

1. An installation for rehabilitating a ballast bed of a track by excavating contaminated ballast, comprising a train of cars moving in an operating direction, a first ballast excavating device preceding a second ballast excavating device, in the operating direction, the first ballast excavating device being arranged to excavate an upper layer of the ballast, a first conveyor band unit arranged to receive and convey the excavated upper ballast layer from the first ballast excavating device to a screening unit arranged to receive the conveyed excavated upper ballast layer, the second ballast excavating device being arranged to excavate the ballast underneath the upper ballast layer, a second conveyor band unit having an end receiving the ballast excavated by the second ballast excavating device and conveying the excavated ballast past the screening unit to an end of the installation for disposal, and a movable deflecting device for selectively deflecting ballast from the second to the first conveyor band unit.

* * * * *